US007149650B2

(12) United States Patent
Grabscheid et al.

(10) Patent No.: US 7,149,650 B2
(45) Date of Patent: Dec. 12, 2006

(54) SYSTEM FOR COMPUTER ASSISTED MONITORING OF A CROSS PROFILE OF A QUALITY PARAMETER IN A MATERIAL WEB

(75) Inventors: Joachim Grabscheid, Gerstetten (DE); Klaus Hermann, Giengen (DE); Thomas Augscheller, Bachhagel (DE); Florian Wegmann, Herbrechtingen (DE); Roland Mayer, Heidenheim (DE); Georg Kleiser, Schwaebisch Gmuend (DE)

(73) Assignee: Voith Paper Patent GmbH, Heidenheim (DE)

( * ) Notice: Subject to any disclaimer, the term of this patent is extended or adjusted under 35 U.S.C. 154(b) by 60 days.

(21) Appl. No.: 10/976,743

(22) Filed: Oct. 29, 2004

(65) Prior Publication Data

US 2005/0114077 A1 May 26, 2005

(30) Foreign Application Priority Data

Oct. 30, 2003 (DE) ..... 103 50 743

(51) Int. Cl.
*G06F 101/14* (2006.01)

(52) U.S. Cl. ..... 702/179

(58) Field of Classification Search ..... None
See application file for complete search history.

(56) References Cited

U.S. PATENT DOCUMENTS 5,781,440 A * 7/1998 Adamy ..... 700/122
6,339,727 B1 * 1/2002 Ladd ..... 700/28

* cited by examiner

*Primary Examiner*—Bryan Bui
*Assistant Examiner*—Aditya S. Bhat
(74) *Attorney, Agent, or Firm*—Taylor & Aust, P.C.

(57) ABSTRACT

A system for computer assisted monitoring of a cross profile of a quality parameter of a material web, especially a paper or cardboard web during its production and/or conversion, which includes a measuring system for measuring the cross profile, at least one computer based operations and logic unit for the determination of the standard deviations of at least two interference profiles that are representative for different interferences in the form of different peak groups in the measured cross profile. The different peak groups differentiate in that their peaks have different width ranges. Elements for storage, display and/or further processing of the determined standard deviations are also included.

20 Claims, 4 Drawing Sheets

| GRID IN MM | REF. MACHINE CONSTRUCTION | INTERFERENCES |
|---|---|---|
| 1000 | ROLL-CAMBER<br>REQUIRED PROFILE- HEADBOX | MACHINE WIDE SHEET |
| 200 | CONDITIONING ELEMENTS<br>PRESSURE PISTON/SHOE PRESS | MOIST STRIPS |
| 60 | CORRECTIVE LIMIT<br>NOZZLE TYPE MOISTENING UNIT | |

| GRID IN MM | REF. MACHINE CONSTRUCTION | INTERFERENCES |
|---|---|---|
| 1000 | ROLL-CAMBER<br>REQUIRED PROFILE- HEADBOX | MACHINE WIDE SHEET |
| 200 | CONDITIONING ELEMENTS<br>PRESSURE PISTON/SHOE PRESS | MOIST STRIPS |
| 60 | CORRECTIVE LIMIT<br>NOZZLE TYPE MOISTENING UNIT | |

Fig. 3

SYSTEM FOR COMPUTER ASSISTED MONITORING OF A CROSS PROFILE OF A QUALITY PARAMETER IN A MATERIAL WEB

CROSS REFERENCE TO RELATED APPLICATIONS

This is a non-provisional application based upon German patent application No. 103 50 743.4, entitled SYSTEM FOR COMPUTER ASSISTED MONITORING OF A CROSS PROFILE OF A QUALITY PARAMETER IN A MATERIAL WEB, filed Oct. 30, 2003.

BACKGROUND OF THE INVENTION

1. Field of the Invention

The present invention relates to a system for computer assisted monitoring of a cross profile of a quality parameter of a material web, especially a paper or cardboard web during its production and/or conversion. The cross profile may, for example, relate to the moisture cross profile, the thickness cross profile, the ash cross profile, the basis weight (BW) cross profile, etc.

2. Description of the Related Art

Previously, machine operators were provided with the respective profile by itself and for the evaluation of the quality of the profile, with the standard deviation ($\sigma$ or $2\sigma$ value). With this standard deviation as a basis however, it cannot be determined which type of interferences, for example short and/or long wave interferences are present and whether these could be eliminated by secondary measures, for example a nozzle type moistening apparatus in the case of moisture cross profiles and/or similar devices. The evaluation of a multitude of cross profiles is additionally subject to a relatively high time expenditure. An evaluation over longer time periods is impossible from a practical standpoint, the quantification of effects is difficult, and a classification of interferences is not possible.

What is needed in the art is an improved system for computer assisted monitoring of a cross profile of a quality parameter of a material web with which a detailed evaluation of the quality of a respective cross profile is possible and which especially permits conclusions as to the type of the respective interferences and/or possible corrective feasibilities.

SUMMARY OF THE INVENTION

The present invention provides an improved system for computer assisted monitoring of cross profile of a quality parameter of a material web with which a detailed evaluation of the quality of a respective cross profile is possible and which especially permits conclusions as to the type of the respective interferences and/or possible corrective feasibilities.

The present invention comprises, in one form thereof, a system for computer assisted monitoring of a cross profile of a quality parameter in a material web, especially a paper or cardboard web during its production and/or conversion, which includes a measuring system for measuring the cross profile, at least one computer based operations and logic unit for the determination of the standard deviations of at least two interference profiles that are representative for different interferences in the form of different peak groups in the measured cross profile. The different peak groups differentiate in that their peaks have different width ranges. The present invention also includes elements for storage, display and/or further processing of the determined standard deviations.

The operator can be provided with standard deviations for individual peak groups, or to process these in the allocated process control system. An operator therefore receives important information, for example with regard to the type of interference that exists. In addition, information is provided that is useful with regard to the question as to which corrective measures could at least lessen the interferences. Interferences, for example in the moisture cross profile, having a peak width greater than 1 m, can be removed by a steam blow box, whereas with interferences in the moisture cross profile according to a peak width smaller than for example 60 mm, generally no corrective element can be effective.

The inventive solution especially also provides that a concentration of the large amount of data during saving of individual profiles to the peak widths that are of interest is achieved without however loosing too much information, as is inherent with the calculation of the total standard deviation. This permits faster evaluation of the cross profile progressions, especially over longer periods of time. In addition to classification of the interferences, a quantitative evaluation of the cross profiles over long time periods is especially also possible.

In a preferred embodiment of the present invention elements are also provided for storage, display and/or for further processing of the measured cross profile.

Advantageously one differentiates between a maximum number of peak groups. Differentiation may for example be made between a maximum of four or five peak groups. A distinction is for example feasible between peak groups whose peaks have widths in the following ranges: a) larger than approximately 1 m, b) approximately 1 m to approximately 200 mm, c) approximately 200 mm to approximately 60 mm and d) smaller than approximately 60 mm. However, other desired peak width groups may also be selected. Additionally, the maximum number of peak groups can also be larger or smaller than 4. It is also especially advantageous if at least one corrective element can be activated, in dependence on prevailing standard deviations.

In a preferred practical embodiment of the present invention an initial corrective profile is calculated as an interference profile, initially proceeding from the measured cross profile, by creating the moving mean value over at least essentially the maximum peak width of a first peak group. Preferably, the standard deviation of this first corrective profile is then determined. This standard deviation can serve especially as a measure for the deviations that are larger than the maximum peak width of the first peak group.

As an additional interference profile a first corrected profile can be determined by deducting the first corrective profile from the measured cross profile. The standard deviation of this first corrected profile can then be determined. This standard deviation can then be utilized especially as a measure for the deviations which are the same or smaller than the maximum peak width of the first peak group. Two standard deviations of, for example, two interference profiles are thereby available, whereby one of them is representative for a deviation larger than the maximum peak width of the first peak group, and the other for deviations that are the same or smaller than the maximum peak width of the first peak group.

At least one additional corrective profile and at least one additional corrected profile can then be determined in the same manner and from that the standard deviation, whereby a respective additional corrected profile is determined by deducting the additional corrective profile from the respective previous corrected profile. As many additional corrective profiles and corrected profiles can be determined here, until the last peak group of the predetermined number of peak groups has been considered.

The maximum peak width of the first peak group can especially be larger than the maximum peak width of the subsequently considered peak groups. In the previously cited example the moving mean value can for example in the first instance be composed with a predetermined grid of approximately 1 m, and subsequently with predetermined grids of for example 200 mm and 60 mm. However, other desired grids can be utilized.

Advantageously, the chronologically consecutively determined standard deviation values are saved. From the standard obtained deviation values for a given peak group, a long term trend of standard deviation can then be established.

In addition to the standard deviations, machinery data especially, can be stored. From the stored machinery data and standard deviation advantageous or critical machinery adjustments can be concluded, for example through elements of a self-learning algorithm or statistical evaluation/analysis.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein:

FIG. 3 is a table view of an example of a moisture profile which shows exemplary grids that are determined by several machinery related points and known interferences;

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF THE INVENTION

Figures 1, 2:
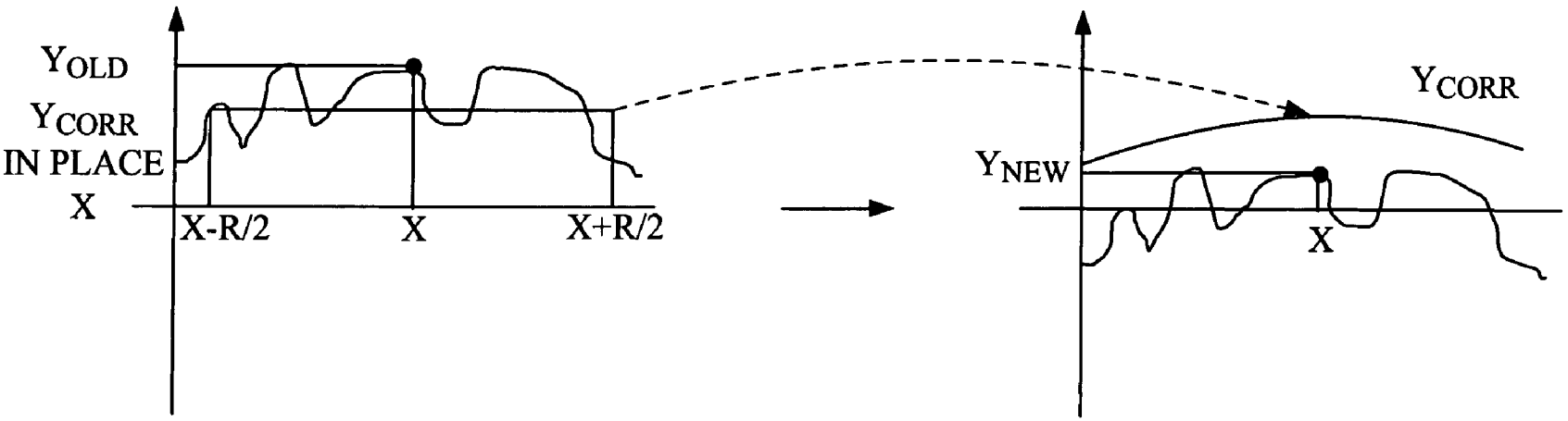
FIG. 1 is a schematic view of an embodiment of a progression of a cross profile in the range of a predetermined grid for a subsequent calculation of the moving mean value, whereby the cross profile can be that of any desired quality parameter.
FIG. 2 is a schematic view of an embodiment of a section of corrective profile that is obtained by the creation of the moving mean value, as well as a section of a corrected profile that is obtained by deducting the corrective profile from the cross profile, which may be the cross profile of any desired quality parameter.

Referring now to the drawings, and more particularly to FIG. 1, there is shown a schematic depiction of the progression of a measured or previously corrected cross profile $Y_{old}$ in the range of a grid R that was predetermined for the purpose of a subsequent calculation of the moving median value. The formation of a moving median value, as described in further detail below, serves the elimination of part of the peaks that occur in the cross profile due to interferences.

The respective moving mean values are produced in a system for computer assisted monitoring of the cross profile in a material web, especially a paper or cardboard web. In this system, monitoring can occur especially during the production and/or conversion of the material web. The relating computer assisted monitoring system includes a measuring system or measuring frame for measurement of the cross profile, at least one computer based operations and logic unit for determination of the standard deviations of at least two interference profiles for two different interferences in the form of different peak groups representative in the measured cross profile. The different peak groups differentiate from each other in that their peaks have a varying width range.

In the existing example differentiation is made between four peak groups. A differentiation is for example feasible between peak groups whose peak widths are within the following ranges: a) larger than approximately 1 m, b) approximately 1 m to approximately 200 mm, c) approximately 200 mm to approximately 60 mm and d) smaller than approximately 60 mm (also see FIG. 3). However, other peak widths are basically also feasible. In addition, differentiations may basically also be made between more than or fewer than four peak groups.

An initial corrective profile can be established as a interference profile by creating the moving mean value over at least essentially the maximum peak width of a first peak group, initially proceeding from the measured cross profile. FIG. 1 shows a schematic depiction of the progression of a measured or preceding corrected cross profile $Y_{old}$ in the range of a predetermined grid $R_2$, that in this example measures 1000 mm (also compare FIG. 3), for a subsequent calculation of the moving mean value. On the abscissa of the diagram according to FIG. 1, the respective position X is protracted across the width of the material web (cross direction) and on the ordinate, the measured value or amplitude.

The moving mean value is then obtained in that averaging occurs over grid R, with a moving value X and while maintaining grid R. For the values X this denotes therefore, that averaging always occurs over a range of X−R/2 to X+R/2. Through the creation of the respective moving mean value a corrective profile $Y_{corr}$ (also see FIGS. 1 and 2) is obtained. This corrective profile $Y_{corr}$ can therefore be calculated through the following equation: $Y_{corr}(X)$+mean value (X−R/2:X+R/2).

Figure 4:
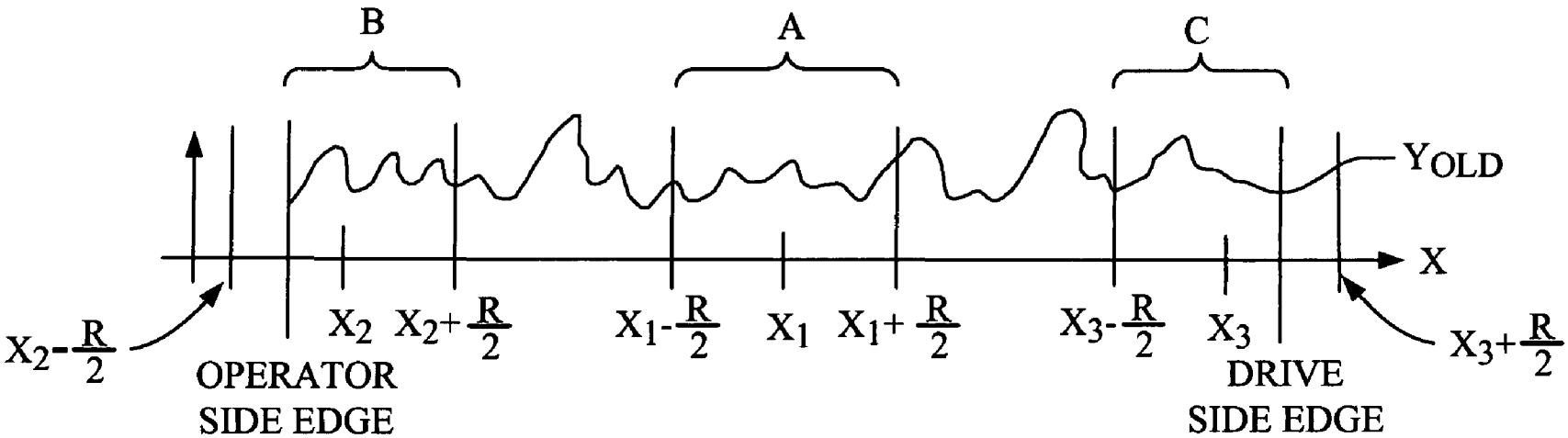
FIG. 4 is a schematic view of the cross profile progression from which can be seen that the mean value in the edge area can be smaller than the grid.

FIG. 4 is a schematic illustration of an exemplary progression of a cross profile from which it can be seen that the average/mean value can be smaller in the edge area than grid R. This applies to the edge area on the operator side (OS), as well as to the edge area on the drive side (DS). In the depiction according to FIG. 4, the mean value range for $X_1$ is indicated as "a"; the mean value range for $X_2$ in the area of the OS-edge is indicated as "b"; and the mean value range for $X_3$ in the area of the DS-edge is indicated as "c".

Peaks whose width is less or the same as 1 m are eliminated through the creation of this moving mean value. By deducting the corrective profile $Y_{corr}$ from the measured or preceding cross profile $Y_{old}$, a corrected profile $Y_{new}$ is obtained, in which now an additional interference profile is available. This corrected profile $Y_{new}$ is calculated via the following equation: $Y_{new}(X)=Y_{old}(X)-\text{Mean value } (X-R/2: X+R/2)=Y_{old}(X)-Y_{corr}(X)$.

FIG. 2 is a schematic depiction where the top curve illustrates the corrective profile $Y_{corr}$ that is obtained through the creation of the moving mean value. It also shows the corrected profile $Y_{new}$ that is obtained by deducting the corrective profile $Y_{corr}$ from the measured or preceding corrected cross profile $Y_{old}$. This process eliminates the wider peaks from the original cross profile. This process can be repeated until the last peak width group is reached.

When calculating the standard deviations or the 2σ-value of the respective corrected profile $Y_{new}$, a measurement is obtained for the deviations having a width up to value R, since interferences having a width larger than R were eliminated. When calculating the standard deviation or the 2σ-value of any given corrective profile $Y_{corr}$, a measurement for the deviations that are wider than the grid R is accordingly obtained. The described processes can be repeated until the last peak width group is reached.

In order to illustrate the example of the moisture profile, the table in FIG. 3 shows several exemplary grids that are determined by several machinery related points and known interferences. According to this, distinctions can be made between peak groups whose peaks have widths in the following ranges: a) larger than approximately 1 m, b) approximately 1 m to approximately 200 mm, c) approximately 200 mm to approximately 60 mm and d) smaller than approximately 60 mm.

In the existing example the 1 m, 200 mm and 60 mm grids, can for example be used consecutively for the creation of the respective moving mean value. In each case, the obtained corrective profiles $Y_{corr}$ can be deducted from the measured cross profile, or the preceding corrected profile $Y_{old}$, in order to obtain the respective new corrected profile $Y_{new}$. In each case the standard deviations or two 2σ-values of the corrective profiles $Y_{corr}$ and the corrected profiles $Y_{new}$ are calculated. The relating processes can be repeated until the last peak group is reached.

The existing cross profile interferences can therefore be organized into at least two, and for example into a maximum of four groups, whereby the following grouping results from the present example: interferences having peak widths larger than 1 m, 1 m to 200 mm, 200 mm to 60 mm and smaller than 60 mm. The standard deviations for the individual groups can be displayed to the operators and/or can be processed in the associated process control system. The operator receives important information regarding the type of interference. In addition, information is available as to with which corrective measures the interferences can at least be reduced. Interferences larger than 1 m can for example be removed with a steam blow box. Generally, no corrective element is effective with interferences smaller than 60 mm.

For example a corrective profile can be calculated from the existing or measured cross profile, initially by the creation of the moving mean value over the maximum peak width of the first peak group. The standard deviation of this corrective profile can serve as a measure for the interferences having widths that are larger than the aforementioned maximum peak width. The corrective profile is then deducted from the original profile. This process eliminates the wider peaks from the original cross profile. This process can be repeated until the last peak group is reached.

The calculated standard deviations can be displayed together with the measured cross profile and/or with at least one corrected profile. In addition, the values can be stored, so that a long term trend of the standard deviation can be recalled for each peak width range. It is also advantageous if machinery data is stored in addition to the standard deviations so that, for example, advantageous or critical machinery adjustments can be recognized with the assistance of self-learning algorithm or statistical evaluations, thereby enabling optimization of machinery operation.

Since the described system function is computer assisted, or includes at least one computer based operation and logic unit the cited procedures, including the introduction of corrective measures, can above all occur automatically.

Figure 5:
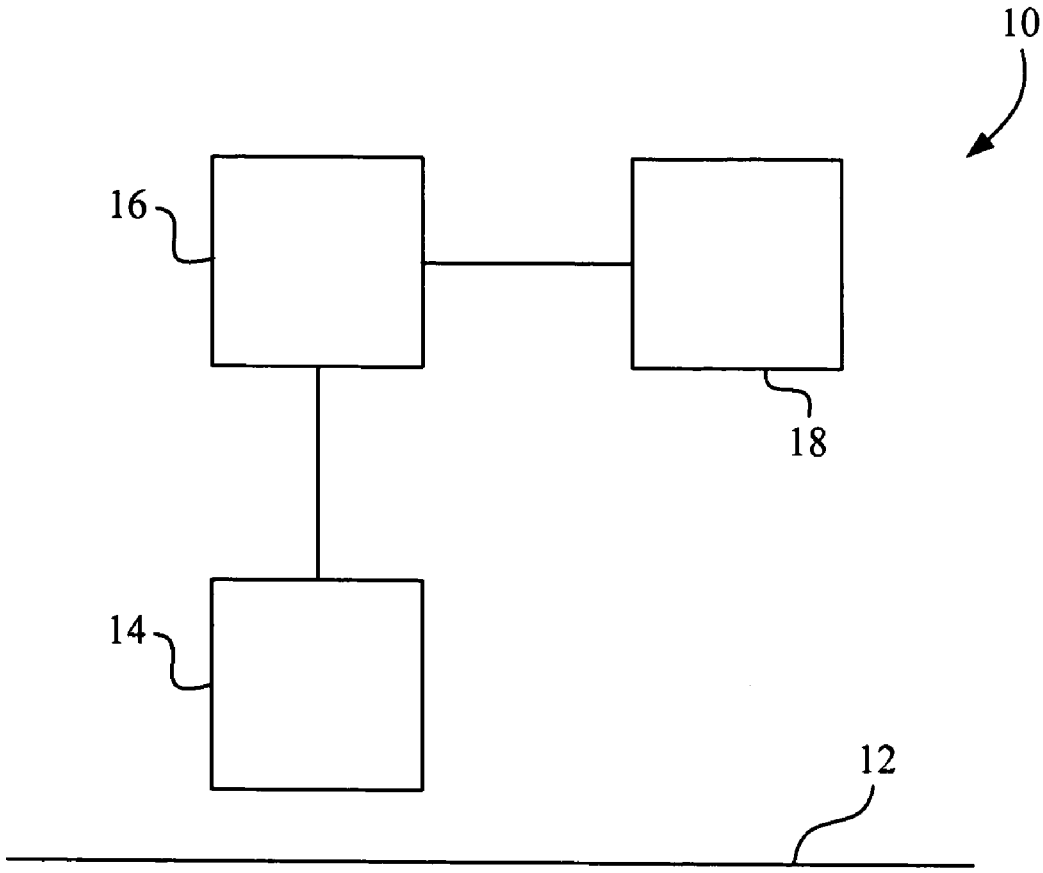
FIG. 5 is a schematic side view of an embodiment of a system for computer assisted monitoring of a cross profile of a quality parameter of a material web according to the present invention.

FIG. 5 is a schematic view of an embodiment of a system 10 for computer assisted monitoring of a cross profile of a quality parameter of a material web 12, especially a paper or cardboard web, during its production and/or conversion, including a measuring system 14 for measuring the cross profile, at least one computer based operations and logic unit 16 for the determination of the standard deviations of at least two interference profiles that are representative for different interferences in the form of different peak groups in the measured cross profile ($Y_{old}$). The different peak groups differentiate in that their peaks have different width ranges. Also included are elements 18 for storage, display and/or further processing of the determined standard deviations.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

REFERENCE SYMBOLS

R grid
$Y_{old}$ measured cross profile, or old corrected profile
$Y_{corr}$ corrective profile
$Y_{new}$ new corrected profile
X position across web

What is claimed is:

1. A system for computer assisted monitoring of a cross profile of a quality parameter of a fiber material web during at least one of a production and a conversion of the fiber material web, said system comprising:

a measuring system for measuring the cross profile and producing a measured cross profile;

at least one computer based operations and logic unit connected to said measuring system, said at least one computer based operations and logic unit for a determination of a plurality of standard deviations of a plurality of interference profiles that are representative for a plurality of different interferences in a form of a plurality of different peak groups in said measured cross profile, said plurality of different peak groups differentiate in that respective peaks have different width ranges;

at least one element connected to said at least one computer based operations and logic unit, said at least one element for at least one of a storage of said plurality of standard deviations, a display of said plurality of standard deviations and a further processing of said plurality of standard deviations.

2. The system of claim 1, wherein said fiber material web is one of a paper web and a cardboard web.

3. The system of claim 1, further including at least one element for at least one of a storage of said measured cross profile, a display of said measured cross profile and a further processing of said measured cross profile.

4. The system of claim 1, wherein a differentiation is made between a maximum number of said plurality of different peak groups.

5. The system of claim 4, wherein said differentiation is made between said plurality of different peak groups whose said respective peaks have said width ranges larger than approximately 1 m.

6. The system of claim 4, wherein said differentiation is made between said plurality of different peak groups whose said respective peaks have said width ranges approximately between 1 m to 200 mm.

7. The system of claim 4, wherein said differentiation is made between said plurality of different peak groups whose said respective peaks have said width ranges approximately between 200 mm to 60 mm.

8. The system of claim 4, wherein said differentiation is made between said plurality of different peak groups whose said respective peaks have said width ranges smaller than approximately 60 mm.

9. The system of claim 1, further including at least one corrective element being activated in dependence on a given said plurality of standard deviations.

10. A system for computer assisted monitoring of a cross profile of a quality parameter of a fiber material web during at least one of a production and a conversion of the fiber material web, said system comprising:

a measuring system for measuring the cross profile and producing a measured cross profile;

at least one computer based operations and logic unit connected to said measuring system, said at least one computer based operations and logic unit for a determination of a plurality of standard deviations of a plurality of interference profiles that are representative for a plurality of different interferences in a form of a plurality of different peak groups in said measured cross profile, said plurality of different peak groups differentiate in that respective peaks have different width ranges;

at least one element connected to said at least one computer based operations and logic unit, said at least one element for at least one of a storage of said plurality of standard deviations, a display of said plurality of standard deviations and a further processing of said plurality of standard deviations; and a first corrective profile being calculated as an interference profile initially proceeding from said measured cross profile by creating a moving mean value over at least essentially a maximum peak width of a first peak group.

11. The system of claim 10, further including a standard deviation of said first corrective profile being determined.

12. The system of claim 10, further including a first corrected profile being determined as an additional interference profile by deducting said first corrective profile from said measured cross profile.

13. The system of claim 12, further including a standard deviation of said first corrected profile being determined.

14. The system of claim 10, further including in a same manner as claim 10 at least one additional corrective profile and at least one additional corrected profile being determined, both a standard deviation for said at least one additional corrective profile and a standard deviation for said at least one additional corrected profile being correspondingly determined, whereby a respective said additional corrected profile being calculated by deducting a respective said additional corrective profile from a preceding corrected profile.

15. The system of claim 14, further including as many said additional corrective profiles and as many corrected profiles being calculated until a last peak group of a given number of said plurality of different peak groups being considered.

16. The system of claim 1, further including a plurality of chronologically consecutively determined values of said plurality of standard deviations being stored for any given said plurality of different peak groups.

17. A system for a computer assisted monitoring of a cross profile of a quality parameter of a fiber material web during at least one of a production and a conversion of the fiber material web, said system comprising:

a measuring system for measuring the cross profile and producing a measured cross profile;

at least one computer based operations and logic unit connected to said measuring system, said at least one computer based operations and logic unit for a determination of a plurality of standard deviations of a plurality of interference profiles that are representative for a plurality of different interferences in a form of a plurality of different peak groups in said measured cross profile, said plurality of different peak groups differentiate in that respective peaks have different width ranges;

at least one element connected to said at least one computer based operations and logic unit, said at least one element for at least one of a storage of said plurality of standard deviations, a display of said plurality of standard deviations and a further processing of said plurality of standard deviations; and a plurality of chronologically consecutively determined values of said plurality of standard deviations for a given said plurality of different peak groups; and a long term trend of standard deviation being established from said plurality of standard deviations for a given said plurality of different peak groups.

18. The system of claim 1, further including stored machinery data.

19. A system for computer assisted monitoring of a cross profile of a quality parameter of a fiber material web during at least one of a production and a conversion of the fiber material web, said system comprising:

a measuring system for measuring the cross profile and producing a measured cross profile;

at least one computer based operations and logic unit connected to said measuring system, said at least one computer based operations and logic unit for a determination of a plurality of standard deviations of a plurality of interference profiles that are representative for a plurality of different interferences in a form of a plurality of different peak groups in said measured cross profile, said plurality of different peak groups differentiate in that respective peaks have different width ranges;

at least one element connected to said at least one computer based operations and logic unit, said at least one element for at least one of a storage of said plurality of standard deviations, a display of said plurality of standard deviations and a further processing of said plurality of standard deviations; and stored machinery data; and a plurality of standard deviations associated with stored machinery data and a plurality of critical machinery adjustments being recognized with an assistance of self-learning algorithm.

20. The system of claim 18, further including a plurality of standard deviations associated with said stored machinery data and a plurality of critical machinery adjustments being recognized with an assistance of a plurality of statistical methods.

* * * * *

UNITED STATES PATENT AND TRADEMARK OFFICE

CERTIFICATE OF CORRECTION

PATENT NO. : 7,149,650 B2
APPLICATION NO. : 10/976743
DATED : December 12, 2006
INVENTOR(S) : Grabscheid et al.

It is certified that error appears in the above-identified patent and that said Letters Patent is hereby corrected as shown below:

COLUMN 8

In line 17, please delete “for a computer”, and substitute therefore --for computer--;
In line 38, please delete “and”;
In line 40, between “deviations” and “for”, insert --being stored--; and
In line 40, after “for”, please delete “a”, and substitute therefore --any--.

COLUMN 9

In line 2, please delete “and”.

Signed and Sealed this

Eleventh Day of September, 2007

JON W. DUDAS
*Director of the United States Patent and Trademark Office*